US011618150B2

(12) United States Patent
Chang

(10) Patent No.: US 11,618,150 B2
(45) Date of Patent: Apr. 4, 2023

(54) TOOLKIT FOR INSTALLING OR REMOVING OBJECTS

(71) Applicant: Kun-Lin Chang, Taoyuan (TW)

(72) Inventor: Kun-Lin Chang, Taoyuan (TW)

( * ) Notice: Subject to any disclaimer, the term of this patent is extended or adjusted under 35 U.S.C. 154(b) by 383 days.

(21) Appl. No.: 16/865,426

(22) Filed: May 4, 2020

(65) Prior Publication Data

US 2021/0339374 A1 Nov. 4, 2021

(51) Int. Cl.

| | |
|---|---|
| ***B25F 5/02*** | (2006.01) |
| ***B25H 3/00*** | (2006.01) |
| *B25B 21/00* | (2006.01) |
| *B25D 9/06* | (2006.01) |

(52) U.S. Cl.

CPC ..... *B25F 5/02* (2013.01); *B25H 3/006* (2013.01); *B25B 21/002* (2013.01); *B25D 9/06* (2013.01); *B25D 2250/181* (2013.01)

(58) Field of Classification Search

CPC ..... B25F 5/02; B25H 3/006

See application file for complete search history.

(56) References Cited

U.S. PATENT DOCUMENTS 869,836 A * 10/1907 Gaynor ..... H01K 3/32 81/53.12
895,625 A * 8/1908 Gaynor ..... H01K 3/32 81/53.12
1,105,406 A * 7/1914 Cook ..... E21B 19/081 173/141
2,196,366 A * 4/1940 Simmons ..... E21B 19/06 254/106
2,487,174 A * 11/1949 Petre ..... B25H 3/003 206/374
4,287,795 A * 9/1981 Curtiss ..... B25B 21/002 81/57.3
4,512,693 A * 4/1985 Swanson ..... B23B 51/00 408/239 R
4,676,703 A * 6/1987 Swanson ..... B25B 21/007 408/239 R
6,266,859 B1 * 7/2001 Hernandez ..... B25B 27/062 29/259
6,895,646 B1 * 5/2005 Houg ..... B25B 27/026 29/261
7,743,683 B2 * 6/2010 Dayton ..... B25F 3/00 173/217
8,479,354 B1 * 7/2013 Doyle ..... A47L 7/009 173/198
8,984,728 B2 * 3/2015 Chen ..... B25B 27/023 29/258
2004/0103511 A1 * 6/2004 Garst ..... B25B 27/0092 29/235
2005/0031424 A1 * 2/2005 Hernandez, Jr. ..... B25B 21/007 408/238
2006/0169106 A1 * 8/2006 Fitpatrick ..... B25B 27/062 81/55
2008/0173138 A1 * 7/2008 Dayton ..... A01G 3/053 30/500

(Continued)

*Primary Examiner* — Nathaniel C Chukwurah
*Assistant Examiner* — Lucas E. A. Palmer
(74) *Attorney, Agent, or Firm* — Bruce Stone LLP; Joseph A. Bruce

(57) ABSTRACT

A toolkit includes a rotation member, a driving member and an engaging member. The driving member is assembled in one side of the rotation member. The engaging member is assembled in another side of the rotation member. Wherein the driving member is rotatable relative to the engaging member by rotating the rotation member.

12 Claims, 11 Drawing Sheets

(56) References Cited

U.S. PATENT DOCUMENTS

| | | | | |
|---|---|---|---|---|
| 2008/0189870 | A1* | 8/2008 | Dayton | B08B 1/04 173/217 |
| 2008/0222867 | A1* | 9/2008 | Robarge | B25B 27/24 29/221.6 |
| 2009/0236572 | A1* | 9/2009 | Laun | B25C 11/02 254/18 |
| 2010/0224034 | A1* | 9/2010 | Fitzpatrick | B25B 21/002 81/57.42 |
| 2010/0251528 | A1* | 10/2010 | Hu | B25B 27/026 29/252 |
| 2011/0067528 | A1* | 3/2011 | Price | B25C 11/00 81/46 |
| 2012/0266709 | A1* | 10/2012 | Wang | B25F 3/00 74/417 |
| 2012/0324695 | A1* | 12/2012 | Morikawa | B25B 21/002 173/1 |
| 2014/0224689 | A1* | 8/2014 | Kang | B25H 3/02 206/373 |
| 2014/0345104 | A1* | 11/2014 | Andrews | B25B 27/023 29/260 |
| 2017/0241464 | A1* | 8/2017 | Vandenberg | B25B 21/002 |
| 2017/0350078 | A1* | 12/2017 | Benjamin | B25C 11/00 |
| 2018/0004071 | A1* | 1/2018 | DeMers | G03B 17/561 |
| 2018/0229350 | A1* | 8/2018 | Naoi | B25B 23/0078 |
| 2018/0345432 | A1* | 12/2018 | Hill | B23Q 5/046 |
| 2019/0086775 | A1* | 3/2019 | DeMers | F16M 11/14 |
| 2019/0099868 | A1* | 4/2019 | Bennett | B25C 11/00 |
| 2019/0152007 | A1* | 5/2019 | Monroy | B25B 21/007 |
| 2020/0141064 | A1* | 5/2020 | Benjamin | E01B 29/26 |
| 2022/0080562 | A1* | 3/2022 | Lawrence | B25B 21/007 |
| 2022/0184784 | A1* | 6/2022 | Kochie | B25B 27/023 |

* cited by examiner

TOOLKIT FOR INSTALLING OR REMOVING OBJECTS

BACKGROUND

Technical Field

The present disclosure relates to a toolkit. More particularly, the present disclosure relates to a toolkit for installing or removing objects.

Description of Related Art

Vehicles, machines or other devices are commonly manufactured by assembling large number of components. These components may be assembled or disassembled frequently. There are many kinds of components, such as screws or jointers are used in the assembling process. The components may be linearly moved or rotated for the assembling, thus particular tools are required to install the components. For example, a wrench is used to tighten or loosen a screw by a rotation operation, an air hammer is used to generate a linear impact force to push or pull the components. However, in some devices with large volume and precision assembly (e.g. a car, an air plane, a CNC machine, etc.), the operation tool should be custom-designed. Furthermore, due to the complicated structure of such kind of devices, it may be difficult to obtain a good working space or a proper operation posture of the user. Therefore, there is a need to develop a tool that can be operated in any situations.

SUMMARY

In some embodiments, the present disclosure provides a toolkit for installing or removing objects. The toolkit includes a rotation member, a driving member and an engaging member. The driving member is assembled in one side of the rotation member. The engaging member is assembled in another side of the rotation member. Wherein the driving member is rotatable relative to the engaging member by rotating the rotation member.

In some embodiments, an angle variation is formed between a central axis of the driving member and a central axis of the engaging member when the driving member is rotated relative to the engaging member.

In some embodiments, the angle variation is ranged from 0 degrees to 180 degrees.

In some embodiments, the rotation member comprises two rotation portions that are rotatable relative to each other, the driving member is assembled with one of the rotation portions, and the engaging member is assembled with the other of the rotation portions.

In some embodiments, the engaging member includes a rod body and an engaging head. The engaging head is removably assembled with the rod body.

In some embodiments, the engaging head includes two catching portions, and the two catching portions are separated by a gap.

In some embodiments, each of the catching portions is shovel shaped.

In some embodiments, each of the catching portions is claw shaped.

In some embodiments, the engaging head further includes a track. The two catching portions are slidably assembled on the track, and a distance of the gap is selectable by sliding the two catching portions.

In some embodiments, the engaging head comprises a socket.

In some embodiments, the toolkit further includes a handle bar, and the handle bar is assembled with the rotation member.

In some embodiments, the toolkit further includes a carry box a carry box for storing each part of the toolkit.

In some embodiment, the present disclosure provides a method for installing or removing objects by using a toolkit, wherein the toolkit comprises a rotation member, a driving member and an engaging member, the driving member is assembled in one side of the rotation member, the engaging member is assembled in another side of the rotation member. The method comprising: outputting a driving force by the driving member; rotating the driving member relative to the engaging member by rotating the rotation member; receiving the driving force by the engaging member; and exerting the driving force to the objects by the engaging member for installing or removing the objects.

In some embodiments, an angle variation is formed between a central axis of the driving member and a central axis of the engaging member when the driving member is rotated relative to the engaging member.

In some embodiments, the angle variation is ranged from 0 degrees to 180 degrees.

In some embodiments, the rotation member comprises two rotation portions that are rotatable relative to each other, the driving member is assembled with one of the rotation portions, the engaging member is assembled with the other of the rotation portions.

In some embodiments, the driving force is a linear driving force or a rotational driving force.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
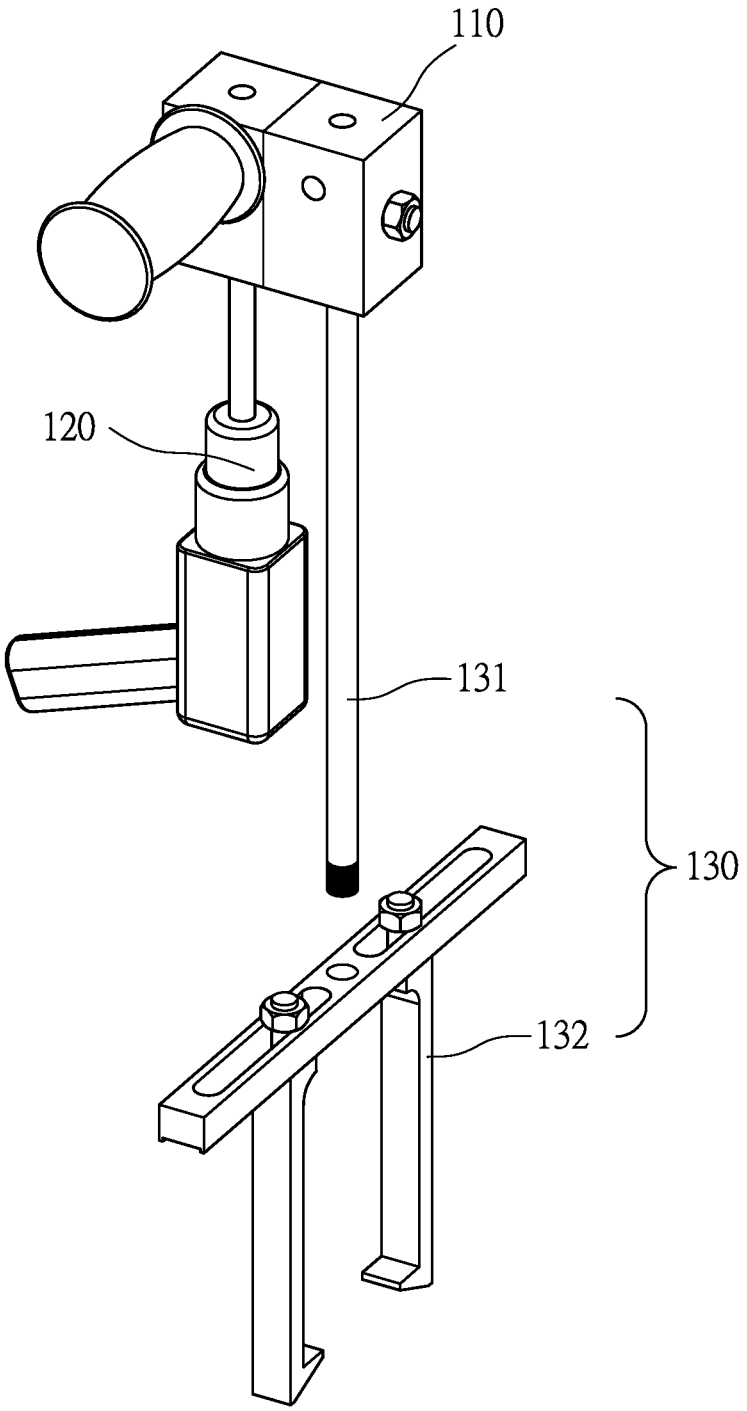
FIG. 1 is a schematic view showing a toolkit for installing or removing objects according to one embodiment of the present disclosure.

FIG. 1 is a schematic view showing a toolkit for installing or removing objects according to one embodiment of the present disclosure. In FIG. 1, a toolkit for installing or removing objects includes a rotation member 110, a driving member 120 and an engaging member 130. The driving member 120 is assembled in one side of the rotation member 110. The engaging member 130 is assembled in another side of the rotation member 110. The driving member 120 can be rotatable relative to the engaging member 130 by rotating the rotation member 110. The engaging member 130 includes a rod body 131 and an engaging head 132. The engaging head 132 is removably assembled with the rod body 131. Therefore, the engaging head 132 can be changed with another one having different shape or functionality. The driving member 120 is used to output a driving force. The driving force can be transferred from the driving member 120 to the engaging member 130 through the rotation member 110. The engaging head 132 can be engaged with an object. The engaging member 130 can receive the driving force, and exert the driving force to the object for installing or removing the object through the engaging head 132. In one embodiment, the driving member 120 can be an air hammer that can provide a linear driving force. In another embodiment, the driving member 120 can also be used to provide a rotational driving force.

Figure 2:
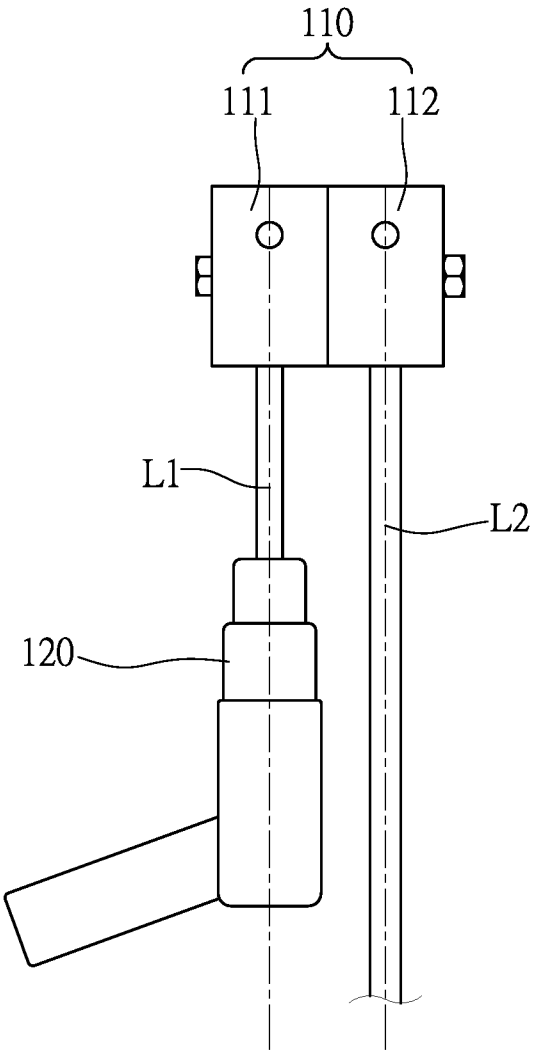
FIG. 2 is a schematic view showing a rotation member of the toolkit of FIG. 1.

FIG. 2 is a schematic view showing a rotation member 110 of the toolkit of FIG. 1. The rotation member includes two rotation portions 111, 112 that can be rotated relative to each other. The driving member 110 is assembled with one of the rotation portions (111 or 112), and the engaging member 130 is assembled with the other of the rotation portions (112 or 111). In some embodiments, an angle variation θ is formed between a central axis L1 of the driving member 120 and a central axis L2 of the engaging member 130 when the driving member 120 is rotated relative to the engaging member 130. The angle variation θ may be ranged from 0 degrees to 180 degrees, depending on various operation situations.

Figure 3:
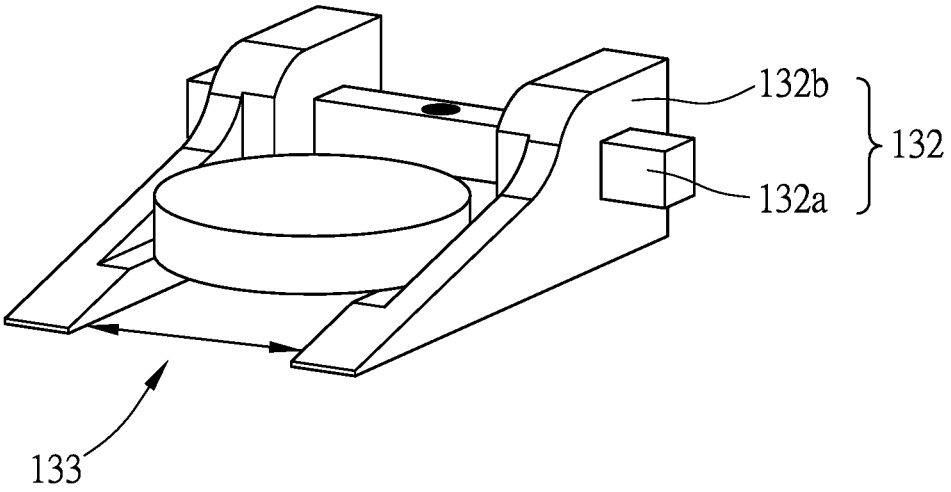
FIG. 3 is a schematic view showing shovel-shaped engaging portions of an engaging head of an engaging member of FIG. 1.
Figure 4:
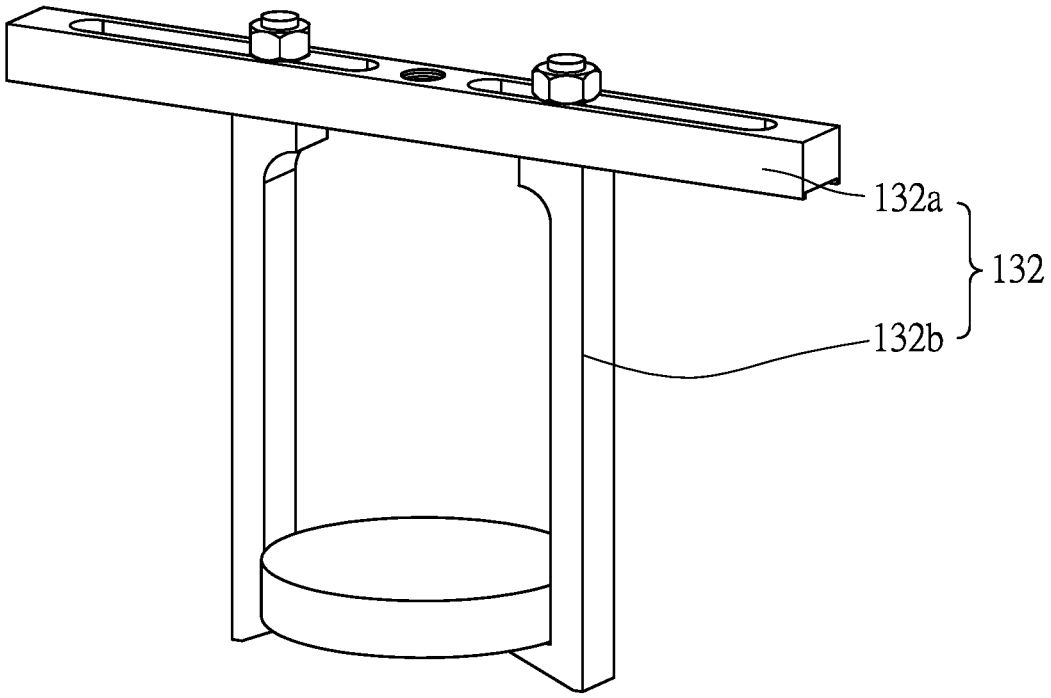
FIG. 4 is a schematic view showing claw-shaped engaging portions of an engaging head of an engaging member of FIG. 1.

FIG. 3 is a schematic view showing shovel-shaped catching portions 132*b* of an engaging head 132 of the engaging member 130 of FIG. 1. FIG. 4 is a schematic view showing claw-shaped catching portions 132*b* of the engaging head 132 of the engaging member 130 of FIG. 1. The engaging head 132 includes two catching portions 132*b*, and the two catching portions 132*b* are separated by a gap 133. The shape of the catching portions 132*b* may be varied with different situations. For example, in FIG. 3, each of the catching portions 132*b* is shovel-shaped. Therefore, the shovel-shaped catching portions 132*b* can touch the bottom of the object and lift the object. In FIG. 4, each of the catching portions 132*b* is claw-shaped. Therefore, the claw-shaped catching portions 132*b* can grab two sides of the object.

In FIG. 3 or FIG. 4, the engaging head 132 further includes a track 132*a*. The two catching portions 132*b* are slidably assembled on the track 132*a*. Therefore, a distance of the gap 133 is selectable by sliding the two catching portions 132*b*, in order to be matched with the objects having different dimensions.

Figure 5:
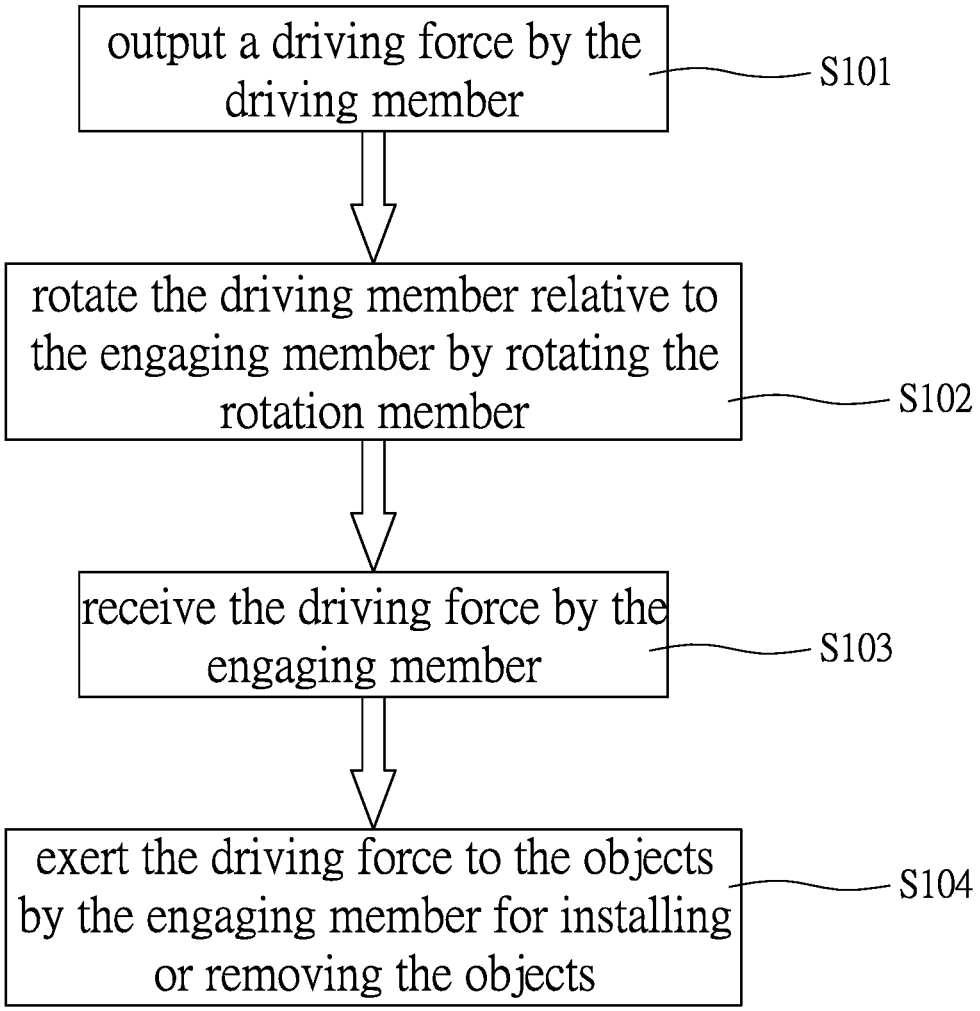
FIG. 5 is a flowchart showing a method for installing or removing objects by using a toolkit according to one embodiment of the present disclosure.

FIG. 5 is a flowchart showing a method for installing or removing objects by using a toolkit according to one embodiment of the present disclosure. The method includes: a step S101 for outputting a driving force by the driving member; a step S102 for rotating the driving member relative to the engaging member by rotating the rotation member; a step S103 for receiving the driving force by the engaging member; and a step S104 for exerting the driving force to the objects by the engaging member for installing or removing the objects. In the previous embodiment, it has known that the angle variation θ between the central axis L1 of the driving member 120 and the central axis L2 of the engaging member 130 can be adjusted by rotating the rotation member 110. By adjusting the angle variation θ, the driving force can be a linear driving force or a rotational driving force. Therefore, the object engaged with the engaging member 132 can be linearly moved or rotated.

There are many situations that object must be installed or removed from its original location by using the toolkit (e.g. repairing a machine, assembling a machine, etc.). FIGS. 6 to 10 show various operation status of the toolkit of the present disclosure. In the following embodiments, the arrow T1 indicates a direction of the driving force outputted from the driving member 120, and the arrow T2 indicates a direction the driving force exerted to the objects by the engaging member 130.

Figure 6:
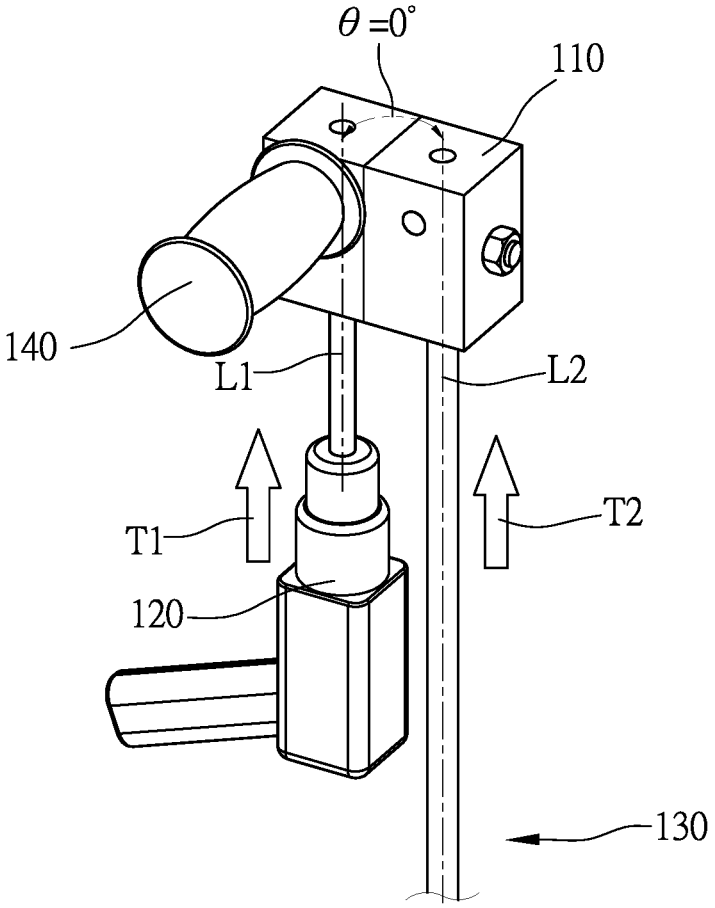
FIG. 6 is a schematic view showing a first operation status of a toolkit according to one embodiment of the present disclosure.

In FIG. 6, the angle variation θ between the central axis L1 of the driving member 120 and the central axis L2 of the engaging member 130 is 0 degrees. In this operation status, the object will be pulled out from its original location by a linear driving force transferred from the engaging member 130. A handle bar 140 may be assembled with the rotation member 110 for assisting the operation.

Figure 7:
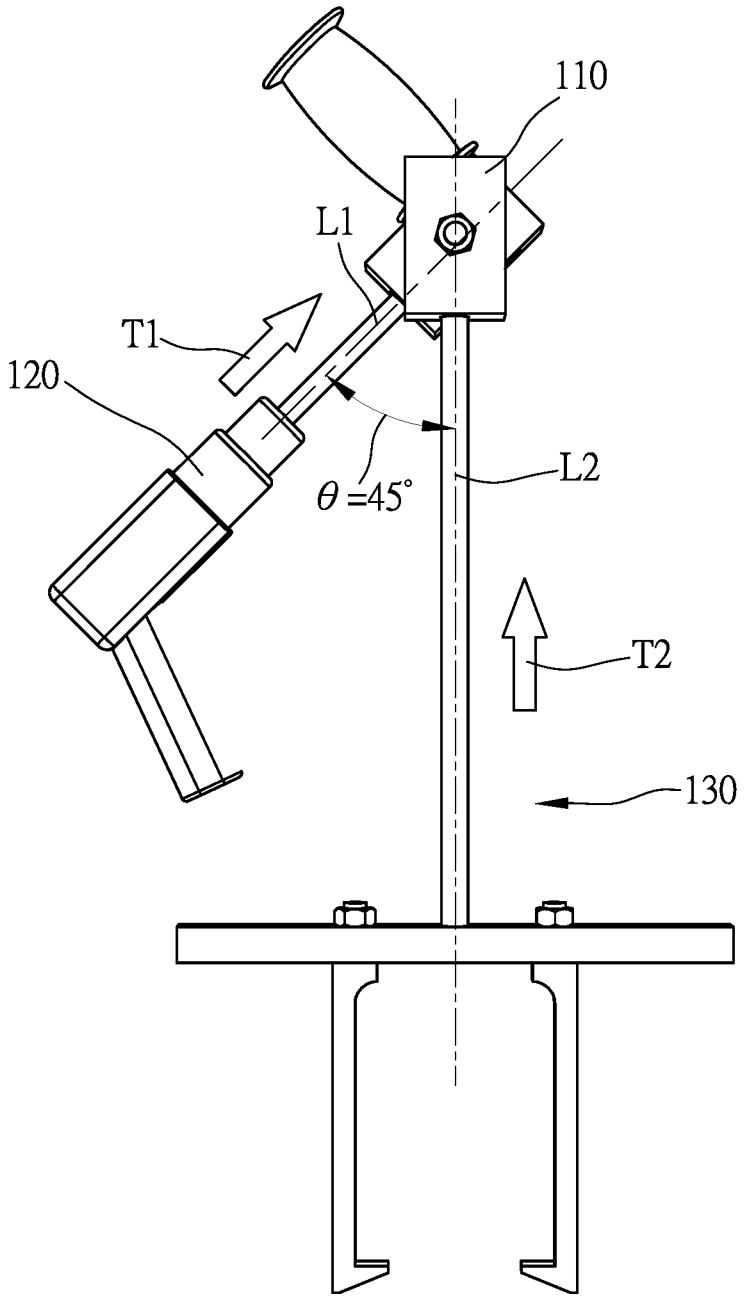
FIG. 7 is a schematic view showing a second operation status of a toolkit according to one embodiment of the present disclosure.

In FIG. 7, the angle variation θ between the central axis L1 of the driving member 120 and the central axis L2 of the engaging member 130 is 45 degrees. In some situations, the working space or the posture of the user may be limited. The driving member 120 and the engaging member 130 can be rotated relative to each other by rotating the rotation member 110 in order to obtain a suitable working space or posture.

Figure 8:
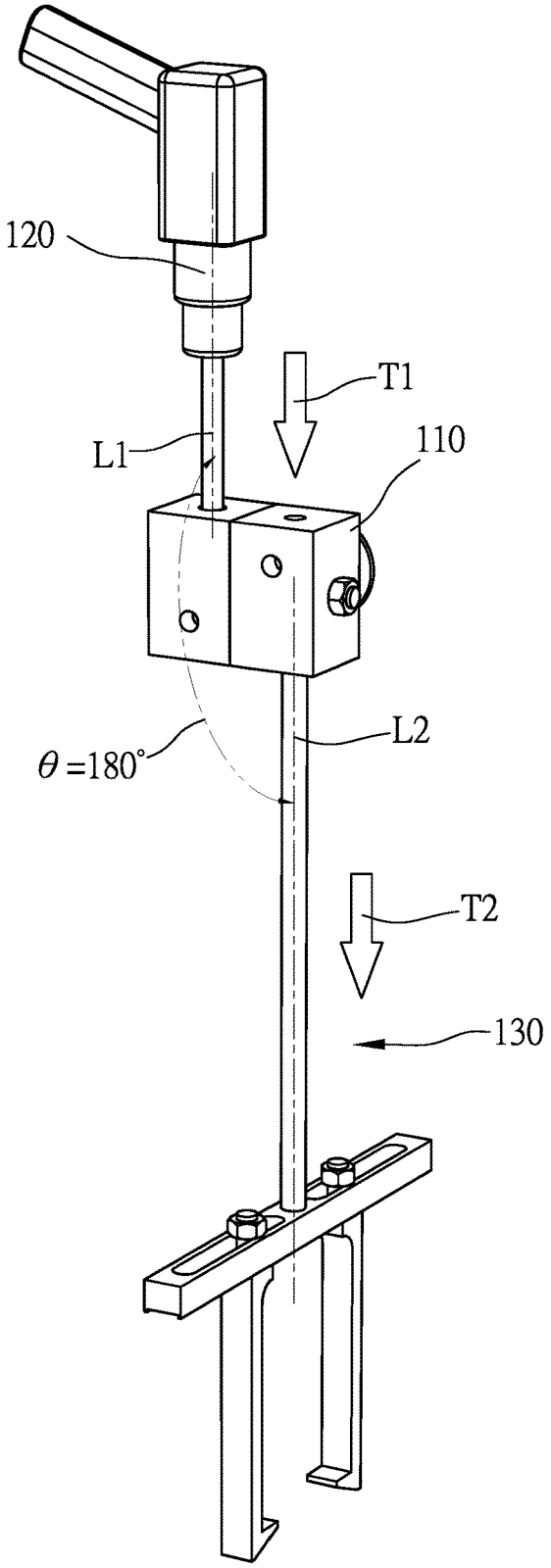
FIG. 8 is a schematic view showing a third operation status of a toolkit according to one embodiment of the present disclosure.

In FIG. 8, the angle variation θ between the central axis L1 of the driving member 120 and the central axis L2 of the engaging member 130 is 180 degrees. In this operation status, the object will be pushed into a location by a linear driving force transferred from the engaging member.

Figure 9:
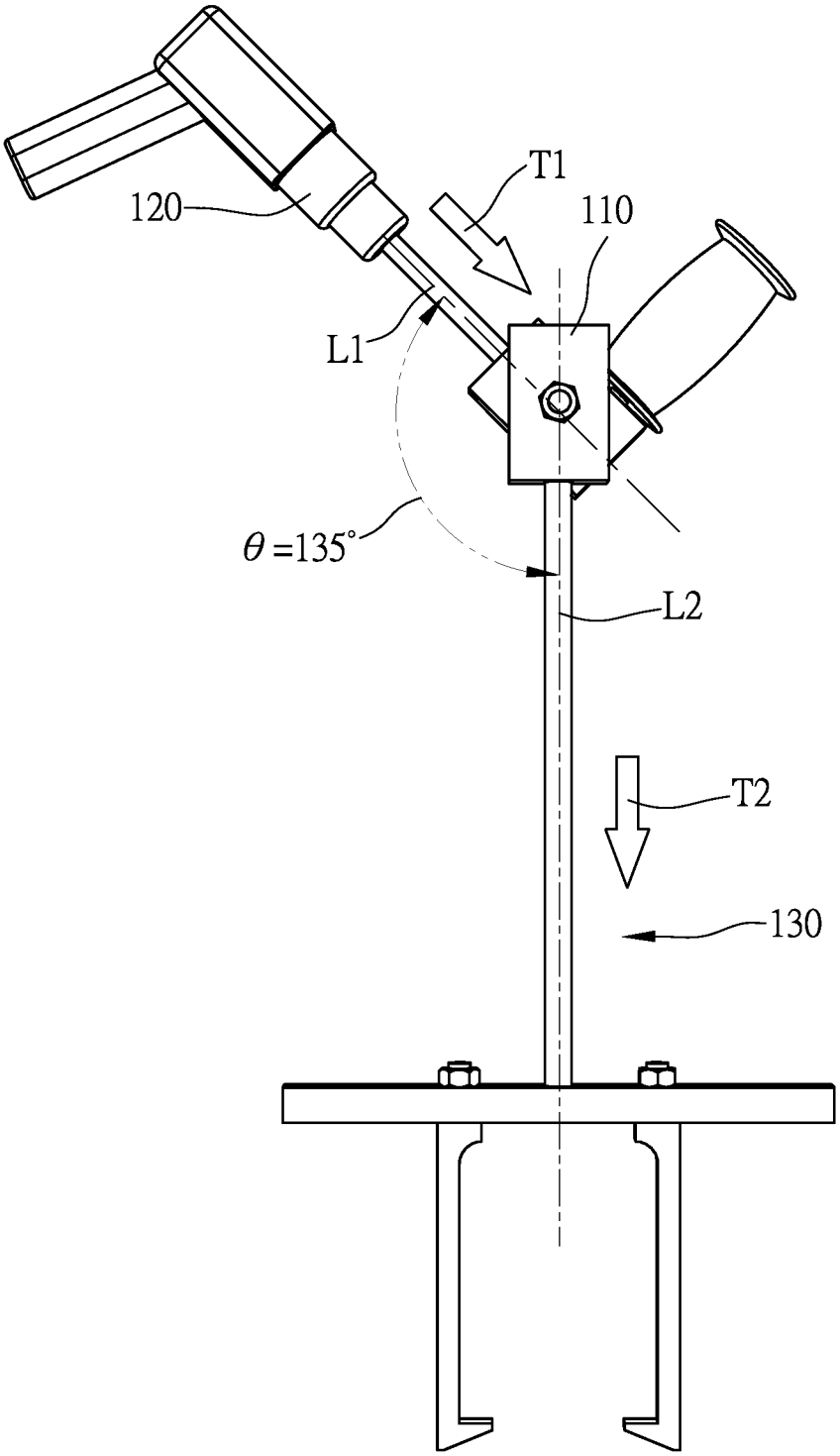
FIG. 9 is a schematic view showing a fourth operation status of a toolkit according to one embodiment of the present disclosure.

In FIG. 9, the angle variation θ between the central axis L1 of the driving member 120 and the central axis L2 of the engaging member 130 is 145 degrees. Similar to the embodiment of FIG. 7, the toolkit of this embodiment is used in a limited work space or a limited posture of the user.

Figure 10:
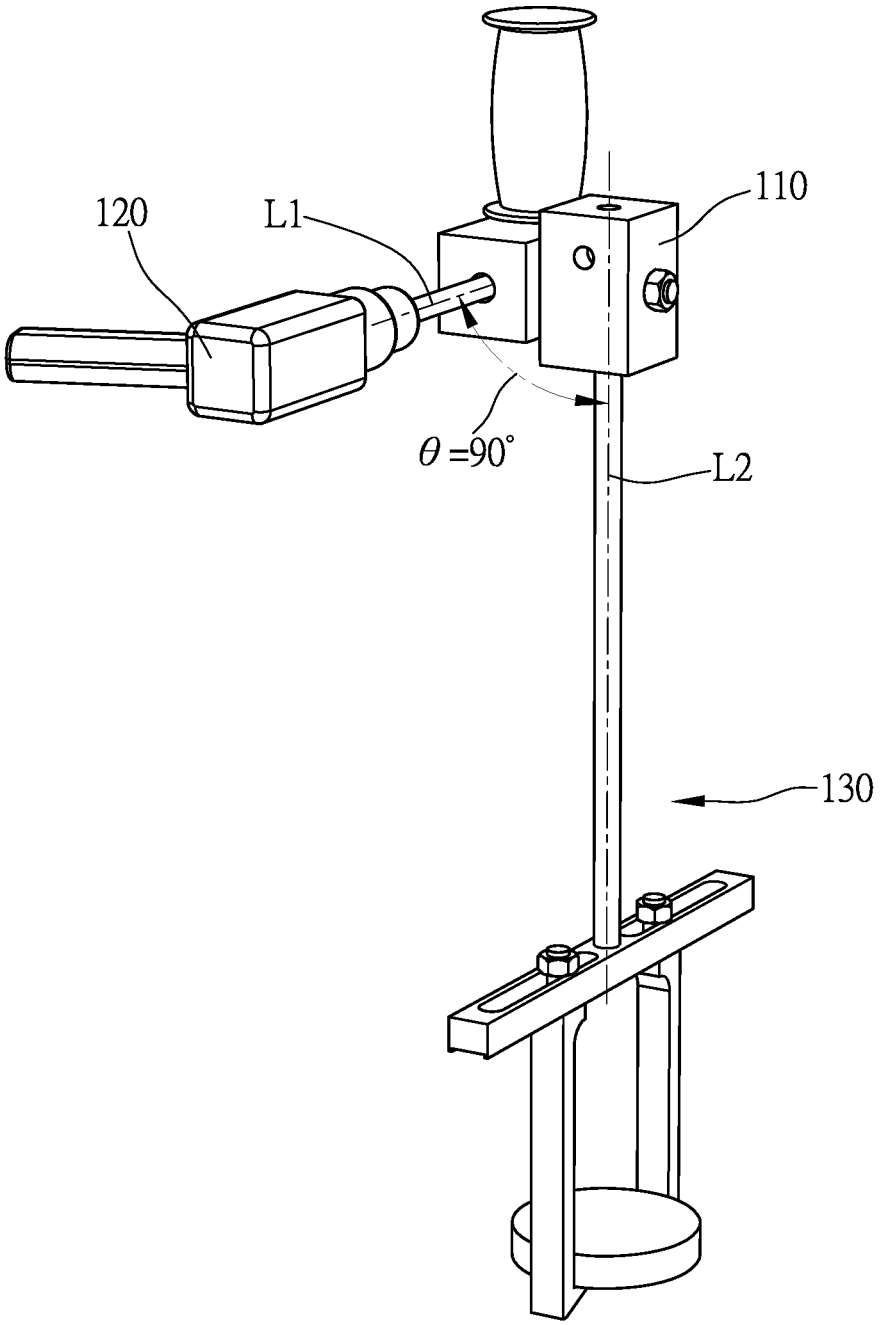
FIG. 10 is a schematic view showing a fifth operation status of a toolkit according to one embodiment of the present disclosure.

In FIG. 10, the angle variation θ between the central axis L1 of the driving member 120 and the central axis L2 of the engaging member 130 is 90 degrees. In this operation status, the direction of the driving force outputted from the driving member 120 (arrow T1) is perpendicular to the paper plane, thereby rotating the engaging member 130 along its central axis L2 and generating a rotational driving force (arrow T2). The engaging head 132 which assembled with the rod body 131 can include a socket. Therefore, the toolkit of this embodiment can be applied to an object (e.g. a screw or the like) which required to be tightened or loosened by rotating it.

Figure 11:
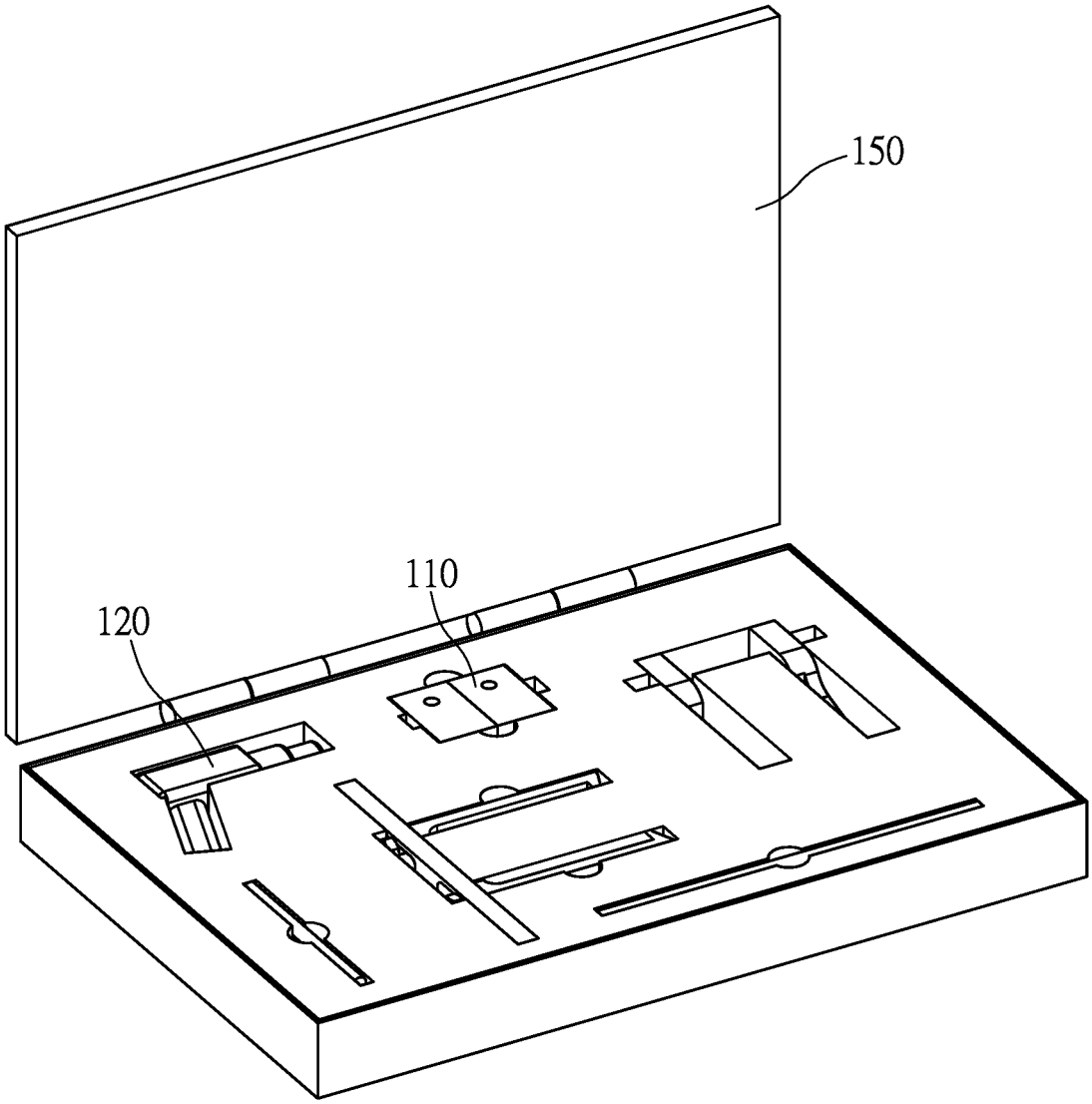
FIG. 11 is a schematic view showing that each part of a toolkit is stored in a carry box according to one embodiment of the present disclosure.

FIG. 11 is a schematic view showing that each part of a toolkit is stored in a carry box 150 according to one embodiment of the present disclosure. In FIG. 11, the carry box 150 is used for storing each part of the toolkit. For example, the driving member 120, the rotation member 110 and the engaging member 130 of the toolkit can be disassembled and stored in the carry box 150. Therefore, the toolkit of the present disclosure has high portability and is convenient to use.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A toolkit for installing or removing objects, comprising:

a rotation member;

a driving member assembled in one side of the rotation member; and an engaging member assembled in another side of the rotation member;

wherein the driving member is rotatable relative to the engaging member by rotating the rotation member, thereby forming an angle variation between the driving member and the engaging member; the driving member provides a linear driving force, a rotational driving force or a combination of the linear driving force and the rotational driving force to an object through adjusting the angle variation.

2. The toolkit of claim 1, wherein the angle variation is formed between a central axis of the driving member and the central axis of the engaging member when the driving member is rotated relative to the engaging member.

3. The toolkit of claim 2, wherein the angle variation is ranged from 0 degrees to 180 degrees.

4. The toolkit of claim 1, wherein the rotation member comprises two rotation portions that are rotatable relative to each other, the driving member is assembled with one of the rotation portions, and the engaging member is assembled with the other of the rotation portions.

5. The toolkit of claim 1, wherein the engaging member comprises:

a rod body; and an engaging head removably assembled with the rod body.

6. The toolkit of claim 5, wherein the engaging head comprises two catching portions, and the two catching portions are separated by a gap.

7. The toolkit of claim 6, wherein each of the catching portions is shovel shaped.

8. The toolkit of claim 6, wherein each of the catching portions is claw shaped.

9. The toolkit of claim 6, wherein the engaging head further comprises a track, the two catching portions are slidably assembled on the track, and a distance of the gap is selectable by sliding the two catching portions.

10. The toolkit of claim 5, wherein the engaging head comprises a socket.

11. The toolkit of claim 1, further comprising:

a handle bar assembled with the rotation member.

12. The toolkit of claim 1, further comprising:

a carry box for storing each part of the toolkit.

* * * * *